US005614481A

United States Patent [19]

Lopez Rangel

[11] Patent Number: 5,614,481

[45] **Date of Patent: *Mar. 25, 1997**

[54] PROCESS FOR OBTAINING AND MANUFACTURING LUBRICANT GREASES

[76] Inventor: Victor D. Lopez Rangel, Zempoala #617. Col., Narvarte, D.F. 03650, Mexico

[ * ] Notice: The term of this patent shall not extend beyond the expiration date of Pat. No. 5,236,606.

[21] Appl. No.: 106,923

[22] Filed: Aug. 16, 1993

Related U.S. Application Data

[63] Continuation-in-part of Ser. No. 814,769, Dec. 30, 1991, Pat. No. 5,236,606.

[51] Int. Cl.[6] ..... C10M 169/00

[52] U.S. Cl. ..... 508/485; 508/501; 508/509; 508/558; 508/583

[58] Field of Search ..... 252/28, 32, 17, 252/21

[56] References Cited

U.S. PATENT DOCUMENTS

| | | | |
|---|---|---|---|
| 3,454,495 | 7/1969 | Schneider | 252/28 |
| 4,256,591 | 3/1981 | Yamamoto et al. | 252/12 |
| 4,378,297 | 3/1983 | Shim | 252/28 |
| 4,396,514 | 8/1983 | Randisi | 252/28 |
| 4,605,563 | 8/1986 | Heine et al. | 252/28 |
| 4,701,272 | 10/1987 | Mori et al. | 252/28 |
| 4,810,395 | 3/1989 | Levy et al. | 252/28 |
| 4,929,369 | 5/1990 | Tury | 252/12 |

*Primary Examiner*—Ellen M. McAvoy
*Attorney, Agent, or Firm*—Ladas & Parry

[57] ABSTRACT

There is disclosed an improved process for making a lubricant grease wherein a basic oil is mixed with a thickening compound, a polar compound and an additive or additives to impart desired characteristics to the grease. The improvement includes selecting the basic oil from the group consisting of a polyolester, a silicone oil, a mineral oil, a vegetable oil, glycerine and propylene glycol. The improvement further includes first mixing the basic oil with a mixture of two polar agents in a vessel under constant stirring at a temperature and pressure sufficient to obtain a homogeneous mixture and then and only then reacting the homogenous mixture with the additive or additives and a thickening agent.

11 Claims, No Drawings

PROCESS FOR OBTAINING AND MANUFACTURING LUBRICANT GREASES

This a continuation-in part of application Ser. No. 814, 769 filed on Dec. 30, 1991 now U.S. Pat. No. 5,236,606.

BACKGROUND OF THE INVENTION

The present invention relates to a process to manufacture, in a laboratory and/or on industrial scale, mineral or synthetic or silicone lubricant greases, in which hydrophilic or hydrophobic silicon dioxide (fumed silica) or precipitated and ground silicic acid are mixed with mineral oils or vegetable oils or synthetic esters or silicone oils or glycerine or propylene glycol at relatively low temperature and pressure, including atmospheric pressures. As a result, the control of the mixture as well as the control of the thickening or polymerization reaction are facilitated. The polymerization or thickening reaction may be carried out in a short time relative to existing processes for the manufacture of metallic soap lubricant greases such as sodium, calcium, lithium, magnesium, aluminum and polyurea lubricant greases, in which the saponification or polymerization reaction is carried out at high pressures and temperatures in a considerably greater time, involving high manufacturing costs.

In the prior art, there are some processes that use silicon dioxide as a thickener, such as the process described in U.S. Pat. No. 4,378,297 in which lubricant sealers which are resistant to solvents such as chloroform and carbon disulfide are prepared by forming a grease comprising glycerine, hydrophobic fumed silica, polyethylene glycol and a minor amount of water.

U.S. Pat. No. 4,701,272 discloses a silicone grease composition containing methylphenyl polysiloxane having a specific surface area of at least 130 $m^2/g$, and an alkoxy containing organosiloxane compound. Likewise, South African Patent No. 86/0555 discloses a grease containing a suitable polypropylene glycol, a thickener comprising finely particulate silicon and an extreme pressure functional additive.

However, the greases obtained from these mentioned processes have limited characteristics.

SUMMARY OF THE INVENTION

A principal object of this invention is to provide a process to manufacture, in laboratory and industrial scale, automotive and industrial lubricant greases by mixing hydrophilic or hydrophobic silicon dioxide (fumed silica) or ground precipitated silicic acid (hydrated silica) with solid or liquid additives and a basic oil selected from the group consisting of polyolesters, polyoldiesters, silicone oil, mineral oil, vegetable oils, glycerine and propylene glycol, which oil is previously mixed with two polar agents.

A further object of this invention is to provide lubricant greases that may be applied with great advantages in the food and automotive industries and in industry in general.

Another object of this invention is to provide lubricant greases that include special characteristics of lubrication, purity, resistance to high and low temperatures, to water and some solvents.

An additional object of this invention is to obtain lubricant greases via a simple and economic process that is carried out at lower temperatures and pressures in contrast to the processes of the prior art.

The lubricant greases obtained have a buttery and homogeneous texture, are easily applied manually or pneumatically, with hardness of types 6, 5, 4, 3, 2, 1, 0, 00, and 000 in accordance with the standard of the NLGI grade given in the formulation of the corresponding final product.

These and other objects of the present invention will become clear from a study of the following specification and claims.

DETAILED DESCRIPTION OF THE INVENTION

In accordance with the present invention, there are now provided mineral or vegetable or synthetic or silicone lubricant greases prepared and obtained from several products used as raw materials, which are reacted chemically to give a final product that is a polymer having the characteristics and applications given by the formulation of the disclosed lubricant greases.

In general all liquids have different polarity or combination capacity, and therefore are classified in three large groups: high, medium and low polarity. In the case of this process, mineral oils in general, including pure, heavy or light refined or regenerated mineral oils, have a low polarity. Synthetic esters, polyol esters (such as pentaerythritol tetraester, pentaerythritol tetrapelargonate, trimethylol-propane-tripelargonate) and diesters (such as di-iso-decylester, di-2- ethyl-hexyl-adipate, di-iso-octyl-acelate) which have a high molecular weight of between 370–600, the high weight polyesters, and silicone oils (such as dimethyl and phenylmethyl polisiloxanes) have medium polarity. Thus to prepare and manufacture the lubricant greases of this invention, the "oils" or "synthetic esters" (polyol esters and diesters) "silicone oils" (dimethyl and phenylmethyl polysiloxanes) above mentioned are mixed and reacted with a polar agent. A polar agent, as used herein, refers to a compound having sufficient polarity that when combined with a basic oil in sufficient quantity will cause the basic oil to absorb fumed silica or hydrated silica, causing the basic oil to swell and to exhibit thickening and thixotropic characteristics.

There are different kinds of polar agents that are suitable for practice of the present invention. These include anionics, calionics, bifunctionals, ionics (base)-alcoholic-KOH or non-ionics polar agents, such as the sodium-linear sulphosuccinate, oleyl-trimethylene diamine, ethylene glycol, and polyoxyethylene (4) sorbitan-monostearate, (all compounds having at least eight carbon atoms and one hydroxyl group). It has been found that the polar agent helps the basic oils to absorb the silica containing compounds, causing the basic oils to swell and thereby to acquire thickening and thixotropic characteristics. The preferred polar agents are: ethylene glycol and polyoxyethylene (4) sorbitan-monostearate.

The process of the present invention for preparing and manufacturing lubricant greases comprises the steps of contacting a basic oil selected in accordance with the type and the desired properties of the final product, and from the group consisting of: a mineral or vegetable oil, a synthetic ester (polyol esters and diesters), silicone oils (dimethyl and phenylmethyl polysiloxanes), glycerine and polypropylene glycol, with a polar agent such as ethylene glycol or another similar polar compound in a reaction vessel or reactor at a pressure ranging from about 760 to 585 mm of Hg depending on the altitude of the work place reaction equipment, and a temperature in the range from 25° to 80° C., which may be reached by steam or some other heating means, and under constant stirring in order that the oil be mixed and completely dispersed and be ready to receive a "package of additives" previously selected to give to the final product or lubricant grease, characteristics such as anti-oxidant, anti-rust, antiwear and characteristics of extreme pressure as well as resistance to some solvents and other properties depending on the desired final use.

Examples of the preferred mineral oils are: heavy or light, paraffinic, naphthenic, or regenerated mineral oils. USP (United States Pharmacopeia) and NF (National Formulary).

Examples of the preferred vegetable oils are: castor oil, soy oil, and palm oil.

Examples of the preferred polyol esters are: pentaerythritol tetraester, pentaerythritol-tetrapelargonate, and trimethylolpropane tripelargonate.

Examples of the preferred polyol diesters are: di-iso-decylester, di-2-ethylhexyl-adipate and di-iso-octyl-acelate.

Once the mixture has been completely homogenized and the temperature has been controlled, the hydrophilic or hydrophobic silicon dioxide (fumed silica with a surface area of between 120–300 $m^2/g$) or precipitated silicic acid is added by manual or pneumatic discharge to be uniformly mixed with the selected "basic oil" and with the group or "package of selected additives". The polymerization or thickening reaction is carried out to obtain a uniform mass without lumps and a buttery appearance. However, air may remain trapped or the stirring may not give a homogeneous product and the appearance may be lumpy. In that case, the mass of lubricant grease can be passed through a colloidal mill with the purpose of grinding it to de-aerate and homogenize it. The grease thus obtained is ready to be checked for the final hardness that was obtained, which is in accordance with the formulation developed.

It is advisable to clarify that lubricant greases are classified according to their hardness with the grades " 6, 5, 4, 3, 2, 1, 0, 00, and 000" according to the universal standard of the National Lubricant Grease Institute (NLGI). Therefore in order to obtain a particular hardness degree or type, the viscosity of the "basic oil", either mineral, vegetable, synthetic (polyol esters and diesters) or silicone (dimethyl and phenylmethyl polysiloxanes) fluids, will be selected or adjusted by adding the polar agent and the thickening agent, in this case, the hydrophilic or hydrophobic fumed silica or precipitated and ground silicic acid, to obtain the lubricant grease with the desired hardness degree.

In light of the above, a product or mass will be obtained, in this case of mineral or vegetable or synthetic or silicone "lubricant grease" with the lubricating characteristics given by: the package or set of liquid or solid additives, previously selected and quantified in a range of 1 to 15%, by the weight of the total composition, the basic oil and the amount of hydrophilic or hydrophobic fumed silica, and the amount of precipitated and ground silicic acid or hydrated silica, which can range from about 3 to 15%, by weight of the total composition to obtain likewise the desired hardness degree.

The reactor or reaction equipment used in this process may be equipped with a heating and/or cooling system and stirring equipment, preferably high speed stirrer, closed or open to work at pressures ranging from about 760 – to 580 mm of Hg and at temperatures between 25° and 80° C. which can be reached by stirring or heating with steam or another conventional heating means.

This invention is in part based in the fact that the basic oils of the type herein described, if first mixed with a polar agent such as ethylene glycol under constant stirring at a temperature and pressure sufficient to obtain a homogeneous mixture, may be used to form lubricant greases of superior characteristics. Furthermore it has been found that if said basic oils are mixed with a nonionic polar agent, such as polyoxyethylene (4) sorbitan-monostearate(R), in addition to the ethylene glycol, under a strong and constant stirring to reach a temperature of about 45° to 50 ° C. and then mixed with a thickening agent, there is obtained a homogeneous mixture having thixotropic and thickening characteristics, and the mixture may be mixed with solid or liquid additives to form lubricant greases of unexpectedly superior characteristics. The addition of two polar agents allows the basic oils to have the capacity to easily absorb and mix with the fumed silica or precipitated and ground silicic acid and thereby the capacity to swell, thereby increasing the viscosity or hardness of the obtained mass.

In this respect, the order in which the components are mixed shows that the lubricant greases formed by first mixing the basic oil with one and/or two polar agents under temperature and pressure conditions to form a homogeneous mixture, followed by the addition of additives and the thickening agent (or vice versa), have characteristics which are superior to those of lubricant greases formed by mixing the same components in an order which does not first include formation of a homogeneous mixture of the oil and polar agent.

The amount of the used polar agents ranges from about 0.5% to 10% by weight of the total composition; and the preferred range is about 1 to 5% by weight of the total composition.

The amount of the used additives ranges from about 1 to 15% by weight of the total composition. The preferred range is from about 1 to 7% by weight of the total composition.

The liquid additives used and suggested are: methyl polymethacrylate, polyolefins, sulphonated propylene-hexadecyl-phosphate with fatty acids, octilade diphenylamine, aminophosphate compound, high molecular substituted imidazoline, nonyl-phenoxy-acetic acid, N-Acyl sarcosine, alkyldiphenyl amine, bis-2,6-di-tertbutylphenol derivative, phosphorous and sulphur containing compound, triazole derivative, butylated-hydroxy-toluene, butylated hydroxyanisole, and alpha-tocopherol.

The solid additives used and suggested are: graphite, molybdenum disulfide, perfluorocarbon resins, fluoroadditives, titanium dioxide, fine zinc powder, fine copper powder.

The following examples are intended to illustrate the invention without limiting it in any way.

EXAMPLE 1

100 Parts of oil and 1.5 parts of polyoxyethylene (4) sorbitan-monostearate were mixed under room temperature and pressure and constant stirring to reach a temperature of from 45° to 50° C. Then 5.5 parts of hydrophilic fumed silica were added gradually to said mixture under strong and constant stirring for obtaining a gelatinous mass having thixotropic characteristics, a hardness degree of from 1–2 (NLGI) and translucid appearance.

EXAMPLE 2

100 Parts of oil plus 1.5 parts of ethylene glycol plus 1.5 parts of polyoxyethylene (4) sorbitan-monostearate plus 12 parts of silicic acid (precipitated and ground hydrated silica) were mixed in the indicated order by strong stirring to obtain a mass having thickening and thixotropic characteristics, and which is slightly lumpy, therefore it was necessary to grind it in a coloidal mill for obtaining a uniform and homogeneous buttery mass.

EXAMPLE 3

Lubricant Grease with EP Characteristics and a Hardness Degree of "2" (NLGI).

| | | |
|---|---|---|
| 1. | Mineral oil (sp = 0.91; Mu = 658 cts): | 80–100 |
| 2. | Ethylene glycol | 2–5 |
| 3. | Methyl polymethacrylate | 1–2 |
| 4. | Sulphonated propylene hexadecyl phosphate with fatty acids | 1–3 |
| 5. | Polyoxyethylene (4) sorbitan-monostearate | 1–5 |
| 6. | Precipitated and ground silicic acid (hydrated silica 87.5 to 90% SiO2) | 12–20 |

The mineral oil (1) having the mentioned characteristics is mixed with the polar agent (2) into an open or closed stainless steel vessel under atmospheric pressure, room temperature and intensive stirring to reach a temperature of about 35° –50° C. The compound (3) which is a thickener and viscosity thixotropic stabilizer is then added under the same operative conditions. The compound (4) is added under constant stirring and later the compound (5). Once said ingredients have been dispersed the silicic acid (6) is added, thereby obtaining a homogeneous product which is then ground in a colloidal mill to obtain a completely dispersed, homogeneous and de-aerated product. After storage for 24 hours, the hardness of this grease is measured with a penetrometer giving a value of between 265–295 milesimes which corresponds to a hardness degree of "2" (NLGI).

EXAMPLE 4

Lubricant Grease with EP Characteristics Obtained by Using Solid Additives.

| | | |
|---|---|---|
| 1. | Oil USP (United States Pharmacopeia) (Mu = 200–210 SUS) | 80–100 |
| 2. | Ethylene Glycol | 1–3 |
| 3. | Methyl polymethacrylate | 1–3 |
| 4. | Aminophosphate compound | 1–3 |
| 5. | Polyoxyethylene (4) sorbitan-monostearate | 1–3 |
| 6. | Hydrophilic fumed silica with a surface area of 120–320 $m^2/g$ | 4–6 |
| 7. | Fluorocarbon Resins | 8–12 |

The refined oil USP (1) is mixed with the polar agent (2) into an open or closed stainless steel vessel under room temperature, atmospheric pressure and intensive stirring to reach a temperature, of about 35° –50° C. The compound (3) which is a thickener and viscosity thixotropic stabilizer is then added under the same operative conditions. The compounds (4) and (5) are added under constant stirring. Once said ingredients have been completely dispersed, the compound (6) is added to obtain a homogeneous mass. Finally the fluorocarbon resins which provide extreme pressure characteristics to the grease are added to said homogeneous mixture. After storage for 24 hours, the obtained grease has a hardness of 265 to 295 milesimes (measured with a penetrometer) which correspond to a hardness degree of "2" (NLGI).

EXAMPLE 5

Synthetic Grease having EP Characteristics and Great Resistance to Low Temperatures and a Hardness Degree of "2" (NLGI).

| | | |
|---|---|---|
| 1. | Pentaerythritol tetra-ester (Mu = 24.5 cts; sg = 0.985) | 80–100 |
| 2. | Ethylene glycol | 1–5 |
| 3. | Octilade diphenylamine | 1–3 |
| 4. | Aminophosphate compound | 1–5 |
| 5. | Polyoxyethylene (4) sorbitan-monostearate | 1–5 |
| 6. | Hydrophilic fumed silica (surface area of 120–300 $m^2/g$) | 5–8 |

The pentaerithritol tetra-ester (1) having the above mentioned characteristics is mixed with the ethylene glycol (2) into a stainless steel vessel under atmospheric pressure, room temperature and intensive stirring to reach a temperature about 35° to 50° C. The compound (3), (4) and (5) are then added under constant stirring and finally the compound(6) is added.

This lubricant grease includes the characteristics of said ester such as the resistance to temperatures from –57° C. to 250° C., making this grease of wide application in the aeronautical and petrochemical industries and industry in general.

After storage for 24 hours the hardness of the obtained grease has a value between 265 to 295 milesimes measured by a penetrometer corresponding to a hardness degree of "2", the grease may be used in a manual or pneumatic form.

EXAMPLE 6

Silicone Lubricant Grease having Geat Resistance to Low Temperatures and Extreme Pressure Characteristics.

| | | | |
|---|---|---|---|
| 1. | Phenyl-methyl silicone fluid (r) of 100 mm2/seg. | 18–20 | parts |
| 2. | Ethylene glycol | 1–5 | |
| 3. | Aminophosphate compound (r) | 1–3 | |
| 4. | Methyl-polymethacrylate (r) | 0.05–1 | |
| 5. | Hydrophilic fumed silica (r) (surface area of 120–300 M2/g) | 4–6 | |

The ingredients (1) and (2) are mixed under atmospheric pressure and intensive stirring to reach a temperature of about 35° –50° C. Then the compounds (3) and (4) are added to obtain a homogeneous mixture. Finally, the compound (5) is added under the same conditions.

The grease obtained is a silicone grease having a great resistance to low temperatures –65° C. and E.P. characteristics. This type of grease is translucent and stable and may be widely used in the petrochemical and bottling industry as well as in other applications. This grease has a hardness degree of "1" (NLGI).

In conclusion, the above examples show that lubricant greases formed by first forming a homogeneous mixture of a basic oil with a polar agent, and subsequently mixing with additives and a thickening agent comprising fumed silica or silicic acid, have characteristics which are superior to those lubricant greases formed by mixing the same components without first forming a homogeneous mixture of the basic oil and polar agent.

Additionally, the lubricant greases formed by first forming a homogeneous mixture of a basic oil with two polar agents such as the ethylene glycol and the polyoxyethylene (4) sorbitan-monostearate by strong and constant stirring, to reach a temperature of about 45° to 50° C., and subsequently mixing with additives and with a thickening agent comprising fumed silica or silicic acid (hydrated silica), have characteristics which are still more superior to those lubricant greases obtained by first mixing the basic oil with a single polar agent.

To obtain lubricant greases with different hardness degrees, first it is necessary to select the type and viscosity of the basic oil and the thickener compound, in order to obtain lubricant greases with hardness degrees between 6, 5, 4, 3, 2, 1, 0, 00 000 according with NLGI scale.

I claim:

1. In a process for making a lubricant grease, wherein a basic oil is mixed with a thickening compound, a polar agent and an additive or additives to impart desired characteristics to the grease, the improvement comprising selecting the basic oil from the group consisting of a polyolester, a silicone oil, a mineral oil, a vegetable oil, glycerine and propylene glycol, and first mixing the basic oil with a mixture of two polar agents in a vessel under constant stirring at a temperature and pressure sufficient to obtain a homogeneous mixture and then and only then mixing said homogenous mixture with the additive or additives and a thickening agent, wherein said mixture of two polar agents comprises (1) a compound having two functional groups and (2) a compound selected from the group consisting of nonionic, cationic and anionic polar agents.

2. A process of claim 1, wherein said mixture of two polar agents comprises ethylene glycol and polyoxyethylene (4) sorbitan-monostearate.

3. A process of claim 1, wherein the step of mixing the basic oil with the two polar agents is carried-out under constant stirring and at temperature from about 25° to about 80° C.

4. A process as claimed in claim 1 wherein each of the polar agents is individually selected from the group consisting of sodium-linear sulphosuccinate, oleyl-trimethylene diamine, ethylene glycol, and polyoxyethylene (4) sorbitan-monostearate.

5. A process as claimed in claim 4, wherein the basic oil is a paraffinic, naphthenic or regenerated mineral oil.

6. A process as claimed in claim 4, wherein the basic oil is castor oil, soy oil or palm oil.

7. A process as claimed in claim 4, wherein the basic oil is a polyol ester selected from the group consisting of pentaerythritol tetraester, pentaerythritol-tetrapelargonate, trimethylolpropane tripelargonate, di-iso-decyl-ester, di-2-ethylhexyl-adipate and di-iso-octyl-acelate.

8. A lubricant grease produced by the process of claim 4.

9. A lubricant grease produced by the process of claim 5.

10. A lubricant grease produced by the process of claim 6.

11. A lubricant grease produced by the process of claim 7.

* * * * *